United States Patent [19]

Janssen et al.

[11] 4,353,534

[45] Oct. 12, 1982

[54] APPARATUS FOR SUPPLYING GAS TO A REVOLVING CYLINDRICAL FURNACE

[75] Inventors: Wilhelm Janssen, Mülheim; Henri F. Seelig, Essen, both of Fed. Rep. of Germany

[73] Assignee: Fried. KRUPP Gesellschaft mit beschränkter Haftung, Essen, Fed. Rep. of Germany

[21] Appl. No.: 206,535

[22] Filed: Nov. 13, 1980

[30] Foreign Application Priority Data

Dec. 24, 1979 [DE] Fed. Rep. of Germany ..... 2952275

[51] Int. Cl.[3] ..... C21B 7/16

[52] U.S. Cl. ..... 266/270; 75/60

[58] Field of Search ..... 75/59, 60; 266/270, 266/280, 99

[56] References Cited

U.S. PATENT DOCUMENTS 3,206,299 9/1965 Senior ..... 75/36

3,330,645 7/1967 De Moustier ..... 75/59

*Primary Examiner*—P. D. Rosenberg

*Attorney, Agent, or Firm*—Becker & Becker, Inc.

[57] ABSTRACT

A device for supplying gas to a revolving cylindrical furnace. Over the length of the rotary axis of the revolving furnace, gas-permeable bricks are used in the region of the fireproof lining of the revolving furnace mantle. The bricks are made of porous, ceramic material, and terminate flush with the surface of the fireproof lining of the revolving furnace. The bricks may have a sheet metal mantle surrounding the same. The gas-permeable bricks have bottom sheet metal plates into which respectively a gas supply connection is welded. Measuring, regulating and control devices may be installed in and on the gas supply connections.

6 Claims, 3 Drawing Figures

APPARATUS FOR SUPPLYING GAS TO A REVOLVING CYLINDRICAL FURNACE

The present invention relates to an apparatus for supplying or feeding gas to a revolving cylindrical furnace.

In the technology of revolving cylindrical furnaces, the fed-in ores, especially iron-bearing ores, are treated by introduced or blown-in gases. It is known, for example, to influence an oxidizing atmosphere of the revolving cylindrical furnace by blowing in reduction means, and vice versa. With this procedure, it is sought to adjust or set a controlled atmosphere of the furnace gases over the entire furnace length, whereby also the temperature profile of the revolving cylindrical furnace is determinable in a desired manner. Thus it is possible to influence the working of the furnace and to adjust or set the course of the chemical conversions of the method.

Experience, however, has shown that no effective temperature control is attainable over the entire furnace length solely by means of heating devices at the head ends of the revolving cylindrical furnace. For this reason, it was decided to distribute special blowing-in elements over the furnace length by means of which the gases can be introduced into the inner chamber of the furnace. On the other hand, lances introduced into the furnace parallel to the rotary axis serve this purpose; however, they did not prove successful because of the structural difficulties connected with their installation. Furthermore, there exists a lack of suitable materials which would guarantee the durability necessary for the extremely high mechanical load.

This could be partly remedied by utilizing cylindrical nozzles, in part also multi-mantle nozzles, or other spray-like devices of metal in the furnace mantle and in the fireproof lining of the furnace. These nozzles, however, have the disadvantage that they quickly scale and accordingly become useless due to changing loads in oxidizing and reducing atmospheres at temperatures of between 600° C. and 1100° C. common in revolving cylindrical furnaces. Additionally, for example, with a purely reducing atmosphere, there occurs a destruction by carburization, and with purely oxidizing atmosphere there occurs a destruction by burning-off.

It is therefore an object of the present invention to provide a device, for supplying gas to revolving cylindrical furnaces, which does not have the aforementioned disadvantages, which is easily installable in the revolving furnace, and which is cost-advantageous in the production and servicing thereof.

This object, and other objects and advantages of the present invention, will appear more clearly from the following specification in connection with the accompanying drawing.

The inventive device for supplying gas to a revolving cylindrical furnace is characterized primarily in that over the length of the rotary axis of the revolving cylindrical furnace, gas-permeable bricks are used in the region of the fireproof lining of the revolving furnace mantle. The advantages of using porous, gas-permeable bricks consist especially in the high operational reliability and safety of these bricks, the better availability of the entire unit, the low production and operating costs, the altogether higher economy of operation, and, last but not least, in longer furnace operating times.

Porous, gas-permeable stones or bricks are known according to the state of the art and are used, for example, in the steel metallurgy at temperatures over 1500° C., where such bricks, for example in pans, serve to introduce gases for rinsing of the liquid steel.

Surprisingly, these bricks can also be used in revolving cylindrical furnaces under the there existing completely different conditions, and moreover such bricks show unexpected high gas transfer rates.

According to a further embodiment of the teaching of the present invention, bricks of porous, ceramic material are used which proved durable even under extreme conditions. Advantageously, the bricks are installed in the fireproof lining of the revolving cylindrical furnace in such a way that the gas discharge surface of the gas supplying device terminates flush with the surface of the lining; in this way, caking and crusting are avoided. If the fireproof lining of the revolving furnace comprises ceramic material capable of reacting relative to the bricks, it is recommended according to a further embodiment of the invention to use bricks provided with a sheet metal mantle. The inventive measures make possible an easy supply of gas to the revolving cylindrical furnace, with the supply of gas, if necessary, being automatically controlled in a manner known in the state of the art. The possibility even offers itself to use bricks which comprise the same material as the fireproof lining of the revolving furnace; though in this case, it is necessary that the bricks provided for the supply of gas to the revolving furnace have a porosity above that of the bricks surrounding them, so that the supplying of gas can be effected in a controlled manner. Expediently, the bricks are installed over the length of the revolving furnace in such a way that at any time an easy interchange or replacement thereof can occur.

Figure 1:
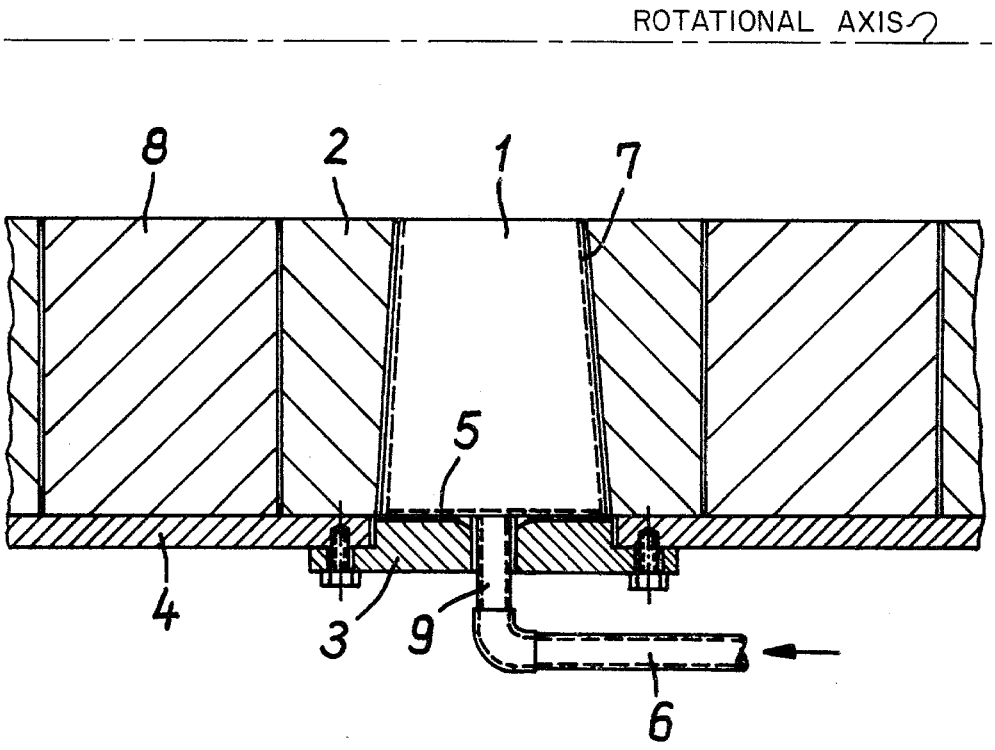
FIG. 1 illustrates an embodiment of the teaching of the present invention as seen in a partial cross section through a revolving cylindrical or drum-type furnace with the arrangement of the porous gas-permeable brick.

Referring now to FIG. 1 in detail, the gas-permeable brick 1 (also known as a rinsing brick) is installed in a perforated brick or firebrick sleeve 2, and is held by a plate 3. The plate 3 is fastened to the furnace mantle 4. A gas supply connection or short feed pipe 9 is welded into the 2 mm thick bottom plate 5 of the gas-permeable brick 1. The gas-permeable brick 1 can also be surrounded with a continuous 0.74 mm thick sheet metal mantle 7. The perforated brick 2 is installed in the annular fireproof brick lining 8 of the revolving cylindrical furnace.

Figure 2:
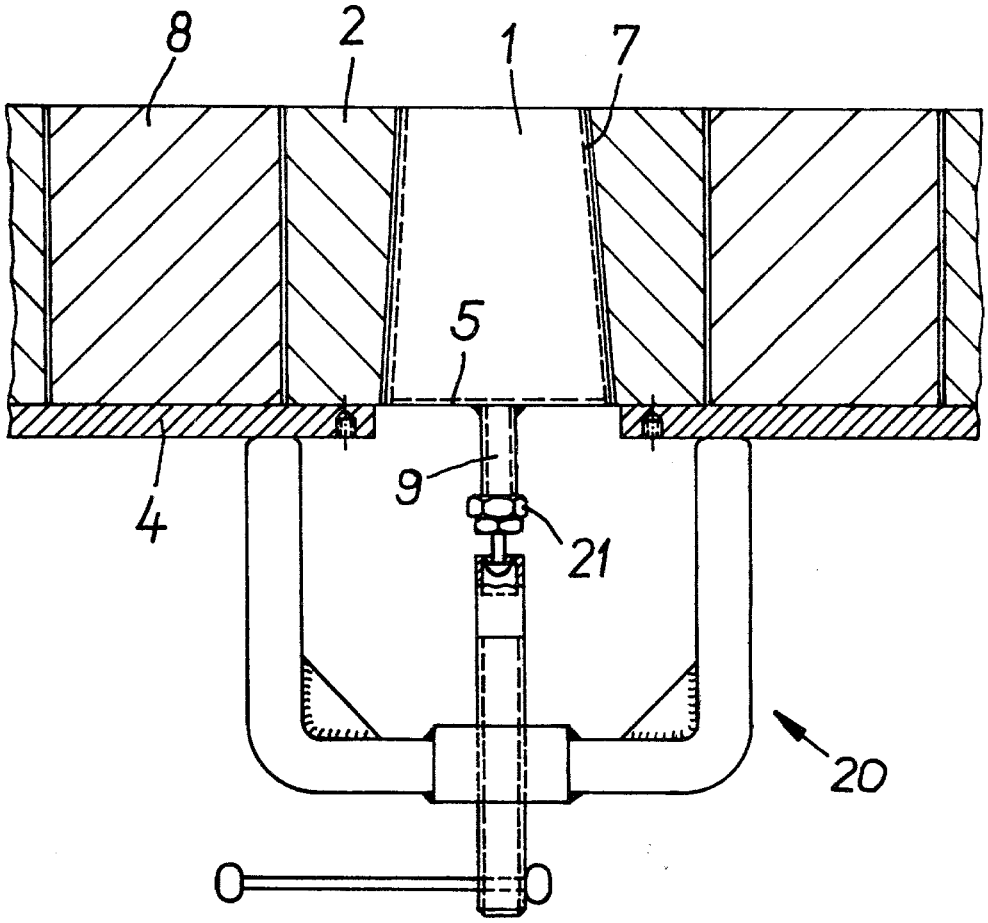
FIG. 2 shows a withdrawing device adjoining a furnace arrangement similar to that of FIG. 1.

Especially advantageous is the simple interchange of the gas-permeable brick 1 during a short shutdown of the revolving cylindrical furnace. This occurs in such a manner that, after loosening of the sleeve of the connecting pipe 6 and removal of the plate 3, the brick 1 itself is in hot condition taken out by means of a simple withdrawing device 20, which is fastened with a counter nut 21 to the gas supply connection 9 as shown in FIG. 2.

The ceramic, porous bricks 1 are installed over the entire length of the rotary axis of the revolving cylindrical furnace, whereby the supply of gas to the furnace can be carried out with the aid of known control means in such a way that below the furnace loading there are blown-in reduction means, and above in the free furnace chamber there are blown-in oxidation means. The control of the furnace atmosphere attainable therewith has proven to be optimal.

Figure 3:
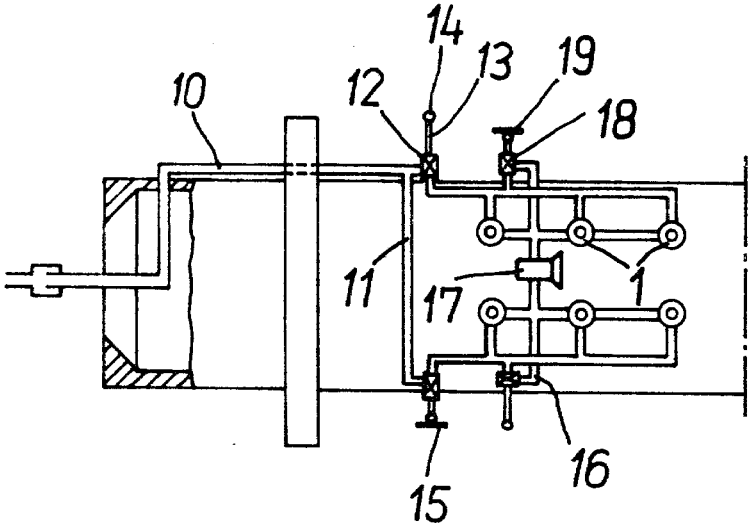
FIG. 3 shows control devices for the arrangement of the present invention.

According to a further embodiment, the porous, ceramic bricks are installed in the fireproof lining of the furnace in an annular or spiral form, and the supply of gas is carried out in conformity with the corresponding control devices as shown in FIG. 3. The end of the gas supply connection 10 terminates in a ring pipe 11, which is provided with a number of connections for valves 12 corresponding to the number of gas-permeable bricks 1 arranged around the circumference. For the sake of clarity only two gas-permeable bricks 1 with their associated parts have been shown while in actual practice a larger number of such bricks are distributed around the circumference in order to ensure uniform operation. In the drawing, only the upper row of gas-permeable bricks is provided with reference symbols. Valve 12 has a radially slidable valve stem 13 which permits the valve to be opened to different degrees. The valve stem 13 has at its end a sensing roller 14 by means of which it can slide along the guideway 15, which is stationary in relation to the furnace. The valve assumes its closed position when the valve stem 13 is fully extended. In the lower part of FIG. 3, the valve stem bearing on the guideway 15 with its sensing roller 14 is fully retracted so that the valve is fully open. A line leads in axial direction from valve 12 to the individual gas-permeable bricks 1. A second connecting line, extending in axial direction, carries primary air from the ring pipe 16 of a blower 11. The ring pipe 16 terminates in the valve 18, which is of the same design as valve 12. In the drawing there is apparent with the valve in the upper position, that the valve stem has been pressed all the way down by the upper guideway 19, whereas in the lower part of the figure the valve stem is extended.

The valves 12 and 18 consequently operate in such a way that one of them is fully closed at all times while the other is opened when the first is closed and subsequently closed again.

The following table shows ceramic materials for the gas-permeable bricks and steel grades for the metal mantle.

In summary, the present invention provides a device for supplying gas to a revolving cylindrical furnace, and is characterized in that gas-permeable bricks are used over the length of the rotary axis of the revolving furnace in the region of the fireproof lining of the revolving furnace mantle 4. The bricks are made of porous, ceramic material. The bricks terminate flush with the surface of the fireproof lining of the furnace, and may have a sheet metal mantle 7 surrounding them. The gas-permeable bricks have bottom plates 5 into which respectively a gas supply connection 9 is welded. Measuring and regulating devices, as well as control devices, may be installed in and on the gas supply connections.

The present invention is, of course, in no way restricted to the specific disclosure of the specification and drawing, but also encompasses any modifications within the scope of the appended claims.

| | | Examples of porous, ceramic material: | | | | |
|---|---|---|---|---|---|---|
| | Grade | $Al_2O_3$ % | Bulk Density g/cm$^3$ | Cold Compressive Strength N/mm$^2$ | Gas Permeability Npm | Remarks |
| (a) purge brick | Alumullite 58 | 58 | 2,40 | 50 | 10 | standard mullite grade for normal operating conditions |
| | Alublast 73 | 73 | 2,40 | 40 | 100 | Highly wear-resistant sintered mullite grade for prolonged purging times with good gas-permeability |
| (b) sheet metal mantle | steel grade Nirosta 4301 ≐ AISI 304 | | | | | $C_r$ = 18%, Ni = 8% |
| | steel grade Nirosta 4016 ≐ ×5 Cr.17. | | | | | |

What we claim is:

1. A device for supplying gas to a revolving cylindrical furnace having an axis of rotation and a furnace mantle with a fireproof lining, said device comprising in combination therewith gas-permeable bricks provided over the length of said rotary axis in the region of said fireproof lining.

2. A device in combination according to claim 1, in which said gas-permeable bricks comprise porous, ceramic material.

3. A device in combination according to claim 2, in which said bricks terminate flush with the surface of said fireproof lining.

4. A device in combination according to claim 3, in which said bricks include a sheet metal mantle.

5. A device in combination according to claim 3, in which said bricks are provided with bottom plates, and a gas supply connection is respectively welded to each of said plates.

6. A device in combination according to claim 5, which includes measuring and control devices installed in and on said gas supply connections.

* * * * *